US010598472B2

(12) United States Patent
LeBlanc

(10) Patent No.: US 10,598,472 B2
(45) Date of Patent: Mar. 24, 2020

(54) FRANGIBLE PROJECTILE AND METHOD OF MANUFACTURE

(71) Applicant: Russell LeBlanc, Miramichi (CA)

(72) Inventor: Russell LeBlanc, Miramichi (CA)

( * ) Notice: Subject to any disclaimer, the term of this patent is extended or adjusted under 35 U.S.C. 154(b) by 0 days.

(21) Appl. No.: 16/278,461

(22) Filed: Feb. 18, 2019

(65) Prior Publication Data

US 2019/0186880 A1 Jun. 20, 2019

Related U.S. Application Data

(62) Division of application No. 15/828,716, filed on Dec. 1, 2017, now abandoned.

(60) Provisional application No. 62/431,003, filed on Dec. 7, 2016.

(51) Int. Cl.

| | |
|---|---|
| ***F42B 6/10*** | (2006.01) |
| ***F42B 12/34*** | (2006.01) |
| ***F42B 12/74*** | (2006.01) |
| ***F42B 6/00*** | (2006.01) |
| ***F42B 8/16*** | (2006.01) |
| ***F42B 12/36*** | (2006.01) |

(52) U.S. Cl.

CPC ..... *F42B 12/34* (2013.01); *F42B 6/00* (2013.01); *F42B 6/10* (2013.01); *F42B 8/16* (2013.01); *F42B 12/367* (2013.01); *F42B 12/745* (2013.01)

(58) Field of Classification Search

CPC ..... F42B 6/10; F42B 8/14; F42B 8/16; F42B 12/34; F42B 12/367; F42B 12/72; F42B 12/74; F42B 12/745

See application file for complete search history.

(56) References Cited

U.S. PATENT DOCUMENTS

| | | | | | |
|---|---|---|---|---|---|
| 3,301,186 | A * | 1/1967 | Henry | F42B 14/02 | 102/526 |
| 3,786,760 | A * | 1/1974 | Feldmann | F42B 14/02 | 102/527 |
| 4,005,660 | A * | 2/1977 | Pichard | F42B 6/10 | 102/501 |
| 4,532,868 | A * | 8/1985 | Gleichaut | F42B 14/02 | 102/527 |
| 4,603,637 | A * | 8/1986 | Snide | F42B 8/16 | 102/517 |
| 4,716,835 | A * | 1/1988 | Leemans | F42B 8/16 | 102/529 |
| 4,939,996 | A * | 7/1990 | Dinkha | F42B 8/16 | 102/444 |
| 5,078,054 | A * | 1/1992 | Ashok | F42B 12/74 | 102/506 |
| 5,108,677 | A * | 4/1992 | Ayres | A63B 43/00 | 264/112 |
| 5,145,512 | A * | 9/1992 | Spencer | B22F 3/16 | 419/28 |
| 5,174,581 | A * | 12/1992 | Goodson | A01K 39/0106 | 119/51.01 |
| 5,214,237 | A * | 5/1993 | McArthur | F42B 12/34 | 102/501 |

(Continued)

*Primary Examiner* — Derrick R Morgan

(74) *Attorney, Agent, or Firm* — Brennan, Manna & Diamond, LLC

(57) ABSTRACT

A projectile, such as a low ricochet, non-toxic, air gun BB, pellet or slingshot projectile, that breaks apart into small pieces or fragments when striking a hard surface, and that is lead free. A method of manufacturing the projectile of the present invention is also disclosed.

12 Claims, 4 Drawing Sheets

(56) References Cited

U.S. PATENT DOCUMENTS 5,237,930 A * 8/1993 Belanger ..... F42B 12/745 102/529
5,353,712 A * 10/1994 Olson ..... F42B 12/40 102/502
5,399,187 A * 3/1995 Mravic ..... B22F 1/0003 75/228
5,471,719 A * 12/1995 Sawyers ..... F42B 6/10 102/508
5,679,920 A * 10/1997 Hallis ..... F42B 12/74 102/398
5,760,331 A * 6/1998 Lowden ..... B22F 1/025 102/439
5,767,438 A * 6/1998 Lang ..... F42B 5/025 102/439
5,831,188 A * 11/1998 Amick ..... B22F 1/0003 75/246
5,877,437 A * 3/1999 Oltrogge ..... B22F 1/0003 75/228
6,045,601 A * 4/2000 Tan ..... C22C 1/045 419/23
6,158,351 A * 12/2000 Mravic ..... B22F 1/0003 102/501
6,199,311 B1 * 3/2001 Foster ..... A01M 31/008 102/506
6,317,946 B1 * 11/2001 Beal ..... F42B 12/74 102/516
6,371,029 B1 * 4/2002 Beal ..... F42B 12/74 102/506
6,457,417 B1 * 10/2002 Beal ..... F42B 12/74 102/517
6,543,365 B1 * 4/2003 Vasel ..... F41B 11/57 102/502
6,551,375 B2 * 4/2003 Siddle ..... B22F 1/0003 419/65
6,823,798 B2 * 11/2004 Amick ..... B22F 3/02 102/448
6,916,354 B2 * 7/2005 Elliott ..... B22F 1/00 102/517
7,337,725 B2 * 3/2008 Queiroz de Aguiar ..... F42B 10/02 102/502
7,353,756 B2 * 4/2008 LeaSure ..... F42B 12/34 102/506
7,690,312 B2 * 4/2010 Smith ..... F42B 7/046 102/517
8,122,832 B1 * 2/2012 Wei ..... F42B 10/00 102/439
8,186,275 B1 * 5/2012 Woodall ..... F42B 12/50 102/502
9,188,416 B1 * 11/2015 Hash ..... F42B 12/74
9,212,878 B2 * 12/2015 Seeman ..... F42B 5/02
9,574,845 B1 * 2/2017 Wyne ..... F41B 11/80
9,879,948 B1 * 1/2018 Puckett ..... F41J 1/01
2001/0050020 A1 * 12/2001 Davis ..... F42B 12/745 102/506
2002/0100389 A1 * 8/2002 May ..... F42B 6/10 102/501
2002/0117074 A1 * 8/2002 Beal ..... F42B 12/74 102/516
2003/0047105 A1 * 3/2003 Vasel ..... F41B 11/57 102/502
2003/0089361 A1 * 5/2003 Christensen ..... F41B 11/57 124/77
2004/0079256 A1 * 4/2004 McMurray ..... F42B 7/08 102/520
2004/0129165 A1 * 7/2004 Cesaroni ..... F42B 12/745 102/516
2005/0034558 A1 * 2/2005 Amick ..... A01K 95/005 75/228
2005/0066841 A1 * 3/2005 Vasel ..... F41B 11/62 102/502
2005/0066850 A1 * 3/2005 Leblanc ..... F42B 7/046 102/517
2005/0188886 A1 * 9/2005 Vasel ..... F41B 11/57 102/502
2007/0000404 A1 * 1/2007 Eberhart ..... F42B 12/74 102/516
2007/0006769 A1 * 1/2007 Dodson ..... F42B 6/10 102/508
2007/0071781 A1 * 3/2007 Louys, Jr. ..... A01N 25/26 424/401
2007/0074637 A1 * 4/2007 Pontieri ..... F42B 6/10 102/501
2007/0181031 A1 * 8/2007 Romero ..... F42B 7/10 102/506
2007/0240601 A1 * 10/2007 Chou ..... F42B 6/10 102/502
2008/0035007 A1 * 2/2008 Nielson ..... C06B 45/00 102/517
2008/0087263 A1 * 4/2008 Chee ..... F41B 3/02 124/20.3
2008/0163779 A1 * 7/2008 Campo ..... F42B 12/40 102/502
2008/0312610 A1 * 12/2008 Binks ..... A61K 9/0021 604/272
2009/0013892 A1 * 1/2009 Judson ..... F42B 10/26 102/502
2009/0217838 A1 * 9/2009 Salva ..... F42B 6/10 102/508
2009/0266264 A1 * 10/2009 Hill ..... F42B 14/02 102/511
2009/0293755 A1 * 12/2009 Riess ..... F42B 12/74 102/507
2010/0024676 A1 * 2/2010 Hugus ..... C06B 33/00 102/514
2010/0242778 A1 * 9/2010 Calero Martinez ..... F42B 12/74 102/517
2010/0251921 A1 * 10/2010 Siddle ..... C22C 27/04 102/501
2010/0258024 A1 * 10/2010 Delhaye ..... F42B 12/40 102/513
2010/0269723 A1 * 10/2010 Hugus ..... F42B 12/08 102/430
2011/0162550 A1 * 7/2011 Hash ..... C22C 1/04 102/506
2012/0152145 A1 * 6/2012 Kuchman ..... F41H 13/0006 102/439
2012/0308426 A1 * 12/2012 Perez ..... B22F 3/26 419/66
2013/0337949 A1 * 12/2013 Macy ..... F41A 9/65 473/577
2014/0318403 A1 * 10/2014 Amick ..... F42B 7/046 102/459
2015/0198427 A1 * 7/2015 Huang ..... F42B 6/10 102/502
2016/0091290 A1 * 3/2016 Sheridan ..... F42B 12/367 102/439
2016/0131462 A1 * 5/2016 Lopez-Pozas Lanuza ..... F42B 6/10 473/613
2016/0131464 A1 * 5/2016 Rubin ..... F42B 12/54 102/501
2016/0216091 A1 * 7/2016 Erickson ..... F42B 12/50
2016/0265889 A1 * 9/2016 Golloher ..... F42B 12/34
2016/0290773 A1 * 10/2016 Seeman ..... F42B 12/745
2017/0082410 A1 * 3/2017 Marshall ..... F42B 6/10
2017/0089674 A1 * 3/2017 Burrow ..... F42B 5/02
2017/0121039 A1 * 5/2017 Ciesiun ..... B33Y 10/00
2017/0205215 A1 * 7/2017 Sloff ..... F42B 12/74
2017/0211918 A1 * 7/2017 Menefee, III ..... F42B 7/046
2017/0217609 A1 * 8/2017 Delhaye ..... B29C 65/08
2017/0219325 A1 * 8/2017 Smith ..... F42B 12/74
2017/0234660 A1 * 8/2017 Carlston ..... F42B 6/10 124/56
2017/0268858 A1 * 9/2017 Morse ..... F42B 12/367
2018/0156587 A1 * 6/2018 Raquin ..... F42B 12/40
2018/0156588 A1 * 6/2018 LeBlanc ..... F42B 12/34

(56) References Cited

U.S. PATENT DOCUMENTS

| | | | | |
|---|---|---|---|---|
| 2018/0164069 | A1* | 6/2018 | Huang | F41B 11/56 |
| 2018/0209773 | A1* | 7/2018 | Lopez-Pozas Lanuza | C08K 3/013 |
| 2018/0224252 | A1* | 8/2018 | O'Rourke | F42B 12/40 |
| 2018/0279607 | A1* | 10/2018 | Guerret | A01M 29/12 |
| 2019/0010095 | A1* | 1/2019 | Kim | C06B 23/001 |
| 2019/0025032 | A1* | 1/2019 | Cooper | F42B 12/40 |
| 2019/0062344 | A1* | 2/2019 | Kudo | C07D 487/04 |
| 2019/0063886 | A1* | 2/2019 | Naud | F42B 4/02 |
| 2019/0113320 | A1* | 4/2019 | Folaron | F42B 12/34 |

* cited by examiner

FRANGIBLE PROJECTILE AND METHOD OF MANUFACTURE

CROSS-REFERENCE TO RELATED APPLICATION

The present application is a divisional of U.S. patent application Ser. No. 15/828,716 filed on Dec. 1, 2017 which claims priority from U.S. Provisional Patent Application Ser. No. 62/431,003 filed on Dec. 7, 2016, all of which is incorporated herein by reference in its entirety.

FIELD OF THE INVENTION

This invention pertains generally to a low ricochet, non-toxic projectile, such as an air gun or slingshot projectile, that can be attracted and retained by a magnet, and a method of manufacturing the same.

BACKGROUND

It is desirable to manufacture low ricochet, non-toxic projectiles, such as air gun or slingshot projectiles, that break apart into small pieces when striking a hard surface, such as a rock, a steel plate or a concrete wall upon impact. For example, air gun projectiles must have enough integrity in their composition that they will not materially deteriorate or break part while passing through the barrel of an air gun or its magazine. It is also desirable for low ricochet, non-toxic air gun projectiles to have the capability of being attracted and retained by a magnet in order to function in air guns that depend upon a magnet to hold the projectile in position prior to firing.

Currently, many projectiles, such as BBs, are made of steel, iron or lead. The steel or iron projectiles tend to ricochet when striking a hard surface which can be dangerous, and lead projectiles do not function in air guns that use a magnet to keep the projectile in place prior to firing. Lead projectiles may also expose the shooter or others to high levels of lead if the shooting area is not properly ventilated or maintained. Further, lead poisoning may result if a young shooter, pet or other animal were to place a lead BB in their mouth or otherwise ingest the same, as they are known to do.

Consequently, there exists a long felt need in the art for a low ricochet, non-toxic projectile that can be attracted and retained by a magnet until fired. There is also a long felt need in the art for a projectile that breaks apart into small pieces or fragments when striking a hard surface such as a rock, a steel plate or a concrete wall upon impact. Finally, there is a long felt need in the art for a frangible, low ricochet projectile that accomplishes all of the forgoing objectives, is lead-free, and that is relatively inexpensive to manufacture and safe and easy to use.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises a low ricochet, non-toxic air gun or slingshot projectile that is capable of being attracted and retained by a magnet and that is comprised of a plurality of particles that are attracted by said magnet and one or more of the following: (a) a plurality of metal particles that are not attracted by said magnet; (b) an elastomer; (c) an elastomer adhesive; (d) a polymer; (e) an organic material; and (f) an inorganic material.

Also disclosed herein is a method for manufacturing a lead free, frangible air gun projectile comprising the steps of: (a) blending a plurality of metal particles with a flow agent to form a homogenous mixture; and (b) placing said homogenous mixture in a die. In a further preferred embodiment of the present invention, the method may further comprise one or more of the following steps of (c) swaging the homogenous mixture in said die with a punch to form said air gun projectile; (d) sintering the air gun projectile; and (e) tumbling the air gun projectile.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DETAILED DESCRIPTION

Figure 1:
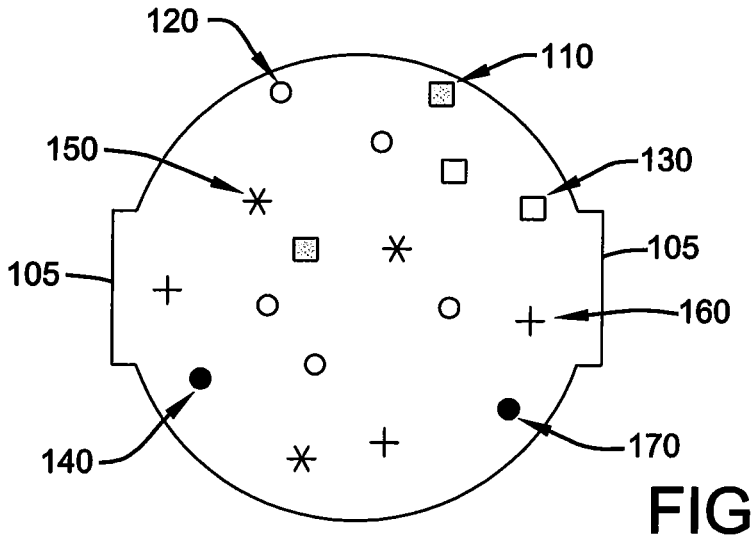
FIG. 1 is a perspective view of a projectile capable of being attracted by a magnet mixed with metal particles that are not attracted by a magnet.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

FIG. 1 is a perspective view of a projectile 100 having a belly band 105 and that is capable of being attracted by a magnet (not shown) mixed with metal particles that are not attracted by a magnet. More specifically, a low ricochet, non-toxic projectile 100, such as an air gun BB or a slingshot projectile, that can be attracted and retained by a magnet (not shown), is comprised of particles 110 that are attracted by both a magnet and by other particles 110 and one or more of the following: (a) metal particles 120 that are not attracted by a magnet; (b) one or more elastomers 130; (c) one or more polymers 140; (d) one or more elastomer adhesives 150; (e) one or more organic materials 160; and (f) one or more inorganic materials 170. Notwithstanding, it is also contemplated that projectile 100 could be comprised solely of materials that are not attracted to a magnet.

Particles 110 may be magnetic, such as magnetized iron. Particles 100 are preferably substantially spherical in shape with a preferred diameter of between 100-150 microns. Metal particles 120 that are not attracted by a magnet may include zinc, tin and/or copper particles. Metal particles 120 are preferably greater than 100 microns in diameter.

Elastomers 130, such as silicone or natural rubber, may be in liquid and/or powdered form. In liquid form, elastomers 130 should have a viscosity of approximately between 2 and 14 centipoise. In powder form, elastomer particles 130 should have a particle size of between 50-75 microns.

Polymers 140, such as latex, high density polyethylene (HDPE) and high density polyethylene (LDPE), may be in liquid and/or powdered form. In liquid form, polymers 140 should have a viscosity of approximately between 2 and 14 centipoise. In powder form, polymer particles 140 should have a particle size of between 50-75 microns.

Elastomer adhesives 150, such as Chloroprene Rubber Cemedine 575 or Master Bond X17, may be used and should have a viscosity of approximately between 2 and 14 centipoise.

Organic material 160, such as honey or maple syrup, may be in liquid and/or powdered form. In liquid form, organic material 160 should have a viscosity of approximately between 2 and 14 centipoise. In powder form, organic material 160 should have a particle size of between 50-75 microns. It is also contemplated that other non-toxic organic materials that decrease fines within a mixture can be used. Inorganic material 170, such as salt, may be in liquid and/or powdered form. For example, if salt is dissolved in a suitable liquid such as water, the viscosity of the resulting liquid should be approximately between 2 and 14 centipoise. It is also contemplated that other non-toxic inorganic materials that decrease fines within a mixture can be used. Further, nonmetallic particles will preferably have low temperature sintering properties.

Additionally, with regard to the powdered versions of elastomers 130, polymers 140, organic materials 160 and inorganic materials 170, the particles should be small enough so that they mix evenly with the magnetic metal particles 110 and/or non-magnetic metal materials 120. It was found that the size of these particles should be between 50-75 microns in diameter. With regard to the liquid versions of elastomers 130, polymers 140, organic materials 160 and inorganic materials 170, it was determined through experimental testing that the viscosity should be approximately 3.0 centipoise. It was further determined that additives, such as water or xylene, may be added as to make said liquid versions of elastomers 130, polymers 140, organic materials 160 and inorganic materials 170 less viscous.

Projectiles 100 may also be swaged to a desired size and hardness and tumbled using suitable equipment known in the art for accomplishing said tasks. For example, projectiles 100 for use with air guns preferably have a diameter of between 0.169 to 0.5 of an inch and a preferred hardness that is capable of withstanding between 32 and 40 Kp of force, as measured by a tablet hardness tester.

When a desired liquid and/or solid component(s) or combinations thereof are mixed with suitable particles and the mixture is then dried or hardened by tumbling, it was found that the dried mixture would need to be roller compacted and processed accordingly in order to achieve the flow rate required for high speed production of projectile 100. More specifically, the homogeneous mixture is tumbled until all of the liquids have evaporated and/or solidified, and the metal particles are suspended within the residue of the evaporated liquids. The desired flow rate for high speed production is 35 seconds for 50 grams to flow through a Hall flowmeter (ASTM B213, MPIF No. 4, ISO No. 39231 with a 0.1 inch diameter calibrated orifice).

Agents such as magnesium stearate (not shown) may be added to roller compacted mixtures and non-roller compacted mixtures in order to increase the flow rate of the mixtures if need be. More specifically, it is contemplated that magnesium stearate in powdered form that is 0.001% to 35% of the homogenous mixture by weight could be used.

It should be noted that materials in liquid and/or powdered form(s) such as: (a) elastomers 130; (b) polymers 140; (c) elastomer adhesives 150; (d) organic materials 160; and (e) inorganic materials 170 help reduce particle fines when mixed with particles that have a high percentage of fines. Particle fines can accumulate on the tooling and cause serious damage to expensive equipment. The above listed materials, when mixed with particles 110 and metal particles 120, also help reduce the density of air gun projectiles 100, if so desired.

The following examples are offered solely to better explain the present invention and nothing contained therein should be construed as a limitation.

EXAMPLE 1

Iron (93.5% by weight), zinc (4% by weight) and copper powders (2% by weight) are combined with 0.5% magnesium stearate (by weight) and mixed. The mixture is converted into suitable air gun projectiles 100 using a single stage or rotary press (not shown). The resulting projectiles 100 may also be tumbled to increase their roundness and lubricated with a non-toxic rust preventative as is well known in the art. The product of this example would be best suited for an air gun having a less powerful spring.

EXAMPLE 2

Iron (94.15% by weight), tin (4% by weight), HDPE powder (0.75% by weight), liquid latex (1%) and N, N' Ethylene Bisstearamide (0.1% by weight) are combined and mixed, and the resulting mixture is processed through a commercial roller compactor in order to increase the flow rate of the mixture. The desired flow rate for high speed production is 35 seconds for 50 grams to flow through a Hall flowmeter. The roller compacted mixture is then converted into suitable air gun or sling shot projectiles 100 using a single stage press or rotary press (not shown). The projectiles 100 may also be tumbled to increase their roundness and lubricated with a non-toxic rust preventative as is well known in the art.

It should be noted that projectiles 100 suitable for air guns made by the methods of this invention should have a resulting diameter of between 0.169 to 0.5 of an inch. The air gun projectiles 100 may also be plated with copper or zinc after the tumbling phase if desired. Plating increases the hardness of the projectiles 100, and improves their aesthetics. If harder projectiles 100 are required, projectiles 100 may be swaged or compressed to a desired hardness using a suitable die or other tools or processes currently known in the art. Projectiles 100 may also be sintered by processes known in the art, and plated with copper or zinc if desired.

More specifically, sintering the frangible projectile of the present invention will help prevent rust, and is similar to a cold bluing process. Sintering temperatures for both air gun and slingshot projectiles should be in a range of between 200-1,600° F., though sintering of slingshot projectiles is not necessarily preferred.

In a further preferred embodiment of the present invention, projectiles 100 are lead free, and metal particles 120 may be from one type of metal or a combination of particles of various metal types. Copper, bronze, brass, tin, zinc, steel, tungsten, tungsten carbide, ferrotungsten, aluminum and bismuth are examples of suitable metal particles 120. Metal particles 120 may be in the form or shape of a powder, granules, flake, chip, or other compactable particulate forms or a combination thereof.

Figure 2A:
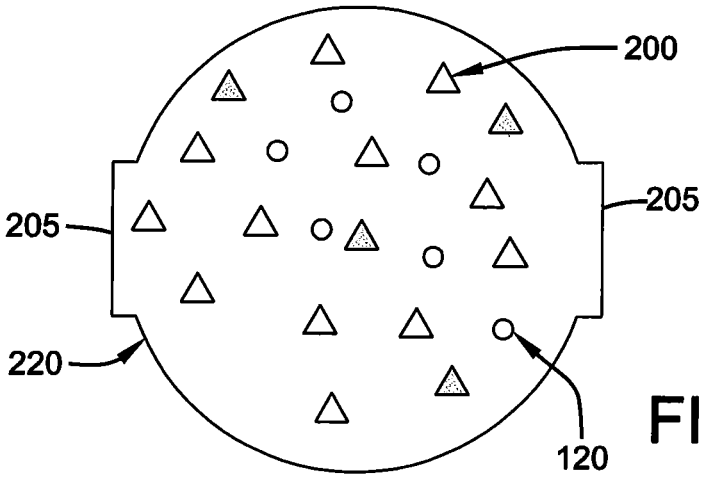
FIG. 2A is a perspective view of a projectile comprised of particles capable of being attracted by a magnet and a dried liquid elastomer.

Having now generally described the preferred composition of projectiles 100, a preferred method of manufacture will now be described. More specifically, as shown in FIG. 2A, metal particles 120 may be mixed with a suitable non-toxic (meaning pharmaceutical grade) flow agent 200 and mixed until a homogenous mixture 220 is obtained. Flow agent 200 is preferably N, N' Ethylene Bisstearamide, but other types of flow agents may also be used without affecting the overall concept of the present invention. The amount of flow agent 200 added to the metal particles 120 will depend on the preferred rate of flow the mixture 220 requires for maximum production rate efficiency, and also the desired frangibility of the resulting air gun or slingshot projectile 100. An addition of 0.2% (weight of the total weight of the particles) of flow agent 200 is a good starting point. By way of example, a suitable flow rate would be less than 35 seconds for 50 grams of homogenous mixture 220 flowing through a professional flow meter.

Figure 2B:
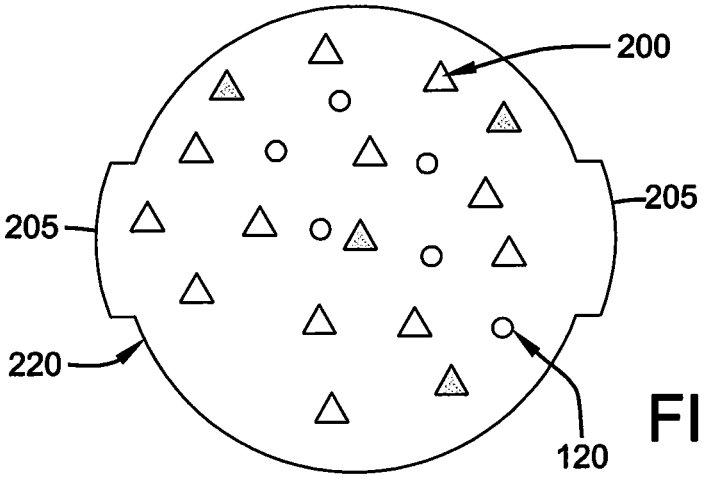
FIG. 2B is a perspective view of the projectile of FIG. 2A, with the belly band partially removed.
Figure 3:
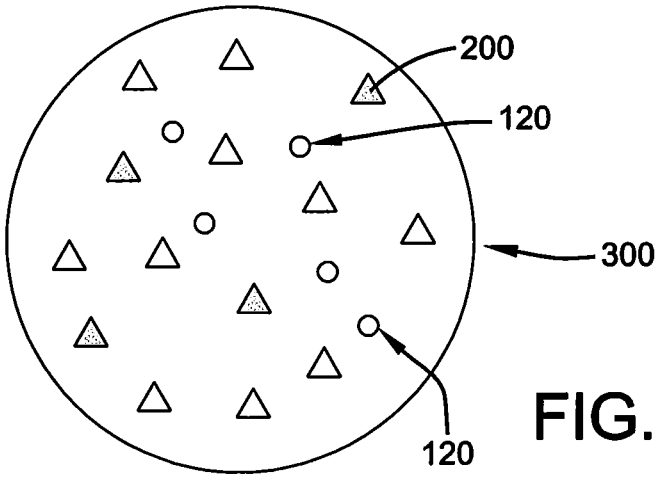
FIG. 3 is a perspective view of a tumbled projectile without a center band.

Like the projectile shown in FIG. 1, the projectile of FIG. 2A also has a belly band 205 that may extend around the circumference of the projectile. FIG. 2B is a perspective view of the projectile of FIG. 2A with belly band 205 partially removed.

A pre-measured amount of homogenous mixture 220 is then placed inside of a suitable die (not shown) having the dimensions of the desired resulting projectile 100. Homogenous mixture 220 is then swaged or compressed inside the die using corresponding internal and external punches (also not shown). One or more dies (not shown) may be used in the swaging process. As described more fully below, a single stage press may be used or a press having multiple dies may also be used, such as a rotary table press. The resultant projectile 100, such as a BB, pellet or slingshot projectile, breaks apart into small pieces when striking a hard surface such as a rock, a steel plate or concrete.

The minimum diameter of the preferred embodiment of projectile 100, such as a BB or pellet, will be 4.3 MM or 0.171 of an inch, and the maximum diameter of the preferred embodiment of BB or pellet 100 will be 12.7 MM or 0.5 of an inch. Air gun BB or pellet 100 may have the shape of a conventional copper or zinc plated iron BB or any pellet shape commonly known in the art. The preferred size of the slingshot projectiles will be 0.25 of an inch up to 0.75 of an inch, and the shape will be similar to BB or air gun projectiles. The slingshot projectiles may be sintered if desired but tumbling is not recommended, as a sharp belly band will create more trauma if these projectiles are used for hunting.

Figure 4:
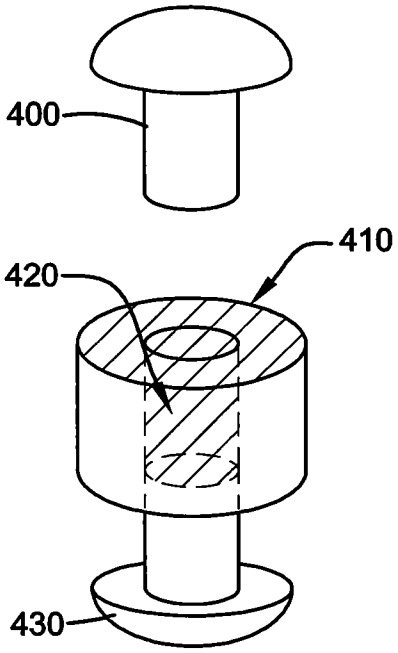
FIG. 4 is a perspective view of a single stage press and associated die/punch with the homogenous mixture filling the cavity of the die.
Figure 5:
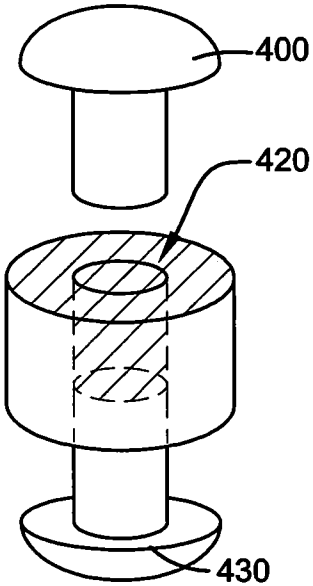
FIG. 5 is a perspective view of a single stage press and associated die/punch with the lower punch being at its lowest point and excess homogenous mixture ready to be removed.
Figure 6:
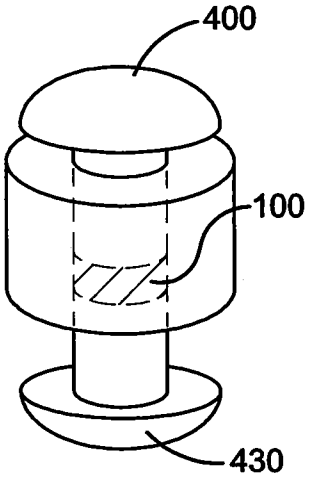
FIG. 6 is a perspective view of a projectile being formed in the single stage press of FIG. 5.

FIG. 4 is a perspective view of a single stage press comprised of an upper punch 400, a die 410, a homogenous mixture 420 (which includes the flow agent) and a lower punch 430. FIG. 5 illustrates the single stage press of FIG. 4, but with lower punch 430 being at its lowest point and excess homogenous mixture 420 ready to be removed from said press. FIG. 6 is a perspective view of projectile 100 being formed in the single stage press of FIG. 5. Ideally, the single stage press will impart 4.8 Kn to 6 Kn of force with minimal dwell time to create an air gun projectile and 4.8 Kn to 6 Kn of force with minimal dwell time to create a slingshot projectile.

Figure 7A:
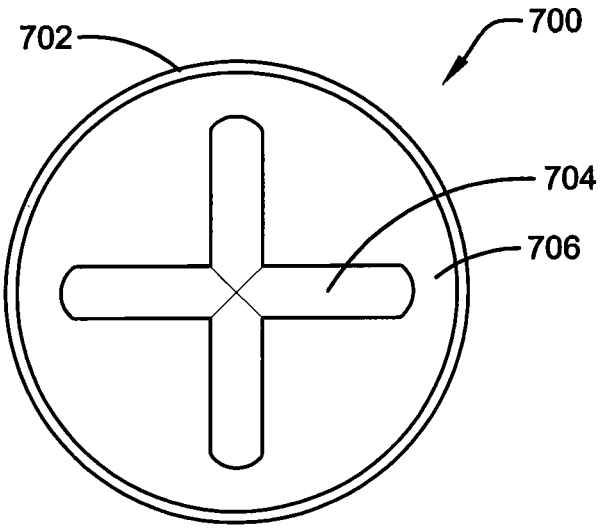
FIG. 7A is a front perspective view of a frangible slingshot projectile of the present invention.
Figure 7B:
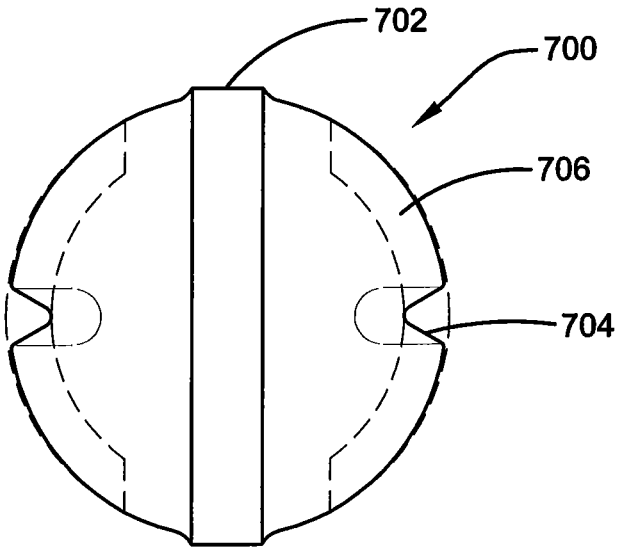
FIG. 7B is a side perspective view of the frangible projectile of FIG. 7A.

FIG. 7A is a front perspective view of a frangible slingshot projectile 700 of the present invention. Projectile 700 is generally spherical, but comprises a belly band 702 and at least one fracture, notch or groove 704 in an outer surface 706 of projectile 700. Belly band 702 may extend along the circumference of projectile 700. Fractures 704 aid in the disintegration of projectile 700 upon impact with its target, and are preferably comprised of a groove or series of grooves, as best shown in FIG. 7B, which is a side perspective view of the frangible projectile 700 of FIG. 7A.

With respect to air gun projectiles, it has been determined through testing that the resulting projectiles will be frangible enough to break apart into smaller pieces when striking a hard surface (such as a steel plate) from approximately 15 feet away at velocities as low as 150 feet per second, but durable enough to withstand a reasonably strong air gun magazine spring. By comparison, conventional air gun projectiles tend to stay intact and ricochet off a hard surface, oftentimes striking the air gun user, when fired from a similar distance and at a similar velocity.

By way of example, the following fragment size analysis was conducted on projectiles of the present invention striking a steel plate having a thickness of approximately 0.092 of an inch from a distance of approximately 15 feet at velocities ranging from 235-550 feet per second:

| Sieve size | Microns | Amount Recovered (grams) | Percentage of Total Amount |
|---|---|---|---|
| 60 | 250 | 50.5 | 68.6% |
| 80 | 177 | 22.9 | 31.1% |
| 100 | 150 | 0.12 | 0.16% |
| 150 | 100 | 0.09 | 0.14% |

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A low ricochet, non-toxic air gun BB that is capable of being attracted and retained by a magnet, wherein the air gun BB is comprised of a honey and a plurality of particles that are attracted by said magnet, and further wherein the air gun BB will break apart when striking a hard surface from at least 15 feet away at a velocity of at least 150 feet per second.

2. The air gun BB of claim 1, wherein said plurality of particles are mixed with a plurality of metal particles that are not attracted by a magnet.

3. . The air gun BB of claim 1, wherein the BB has a hardness of between 32 and 40 kp of force.

4. The air gun projectile of claim 1, wherein the honey is a liquid.

5. The air gun projectile of claim 1, wherein the honey is a powder.

6. A low ricochet, non-toxic air gun BB that is capable of being attracted and retained by a magnet, wherein the air gun BB is comprised of a honey and a plurality of metal particles, and further wherein the air gun BB has a hardness of between 32 and 40 kp of force.

7. The air gun BB of claim 6 further comprised of a belly band.

8. The air gun BB of claim 6 further comprising a plurality of non-magnetic particles.

9. The air gun BB of claim 6 further comprising an elastomer adhesive.

10. The air gun BB of claim 6 further comprising at least one fracture in an outer surface of said air gun BB projectile.

11. The air gun BB of claim 6, wherein said honey is in liquid form.

12. The air gun BB of claim 6, wherein said honey is in powder form.

* * * * *